United States Patent [19]

Meichsner et al.

[11] 4,159,906

[45] Jul. 3, 1979

[54] METHOD AND COMPOSITION FOR THE DESULFURIZATION OF MOLTEN METALS

[75] Inventors: Walter Meichsner, Homberg; Heinrich Röck, Trostberg; Alfred Freissmuth, Trostberg; Horst Prietzel, Trostberg; Heinrich Rellermeyer, Duisburg-Hamborn; Wolfgang Ullrich, Rheinkamp-Baerl; Erich Pfluger, Trostberg; Raymund Sindermann, Tacherting, all of Fed. Rep. of Germany

[73] Assignee: Süddeutsche Kalkstickstoff-Werke Aktiengesellschaft, Trostberg, Fed. Rep. of Germany

[21] Appl. No.: 797,973

[22] Filed: May 18, 1977

Related U.S. Application Data

[62] Division of Ser. No. 408,954, Oct. 23, 1973, Pat. No. 4,078,915.

[51] Int. Cl.[2] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,551,139 | 12/1970 | Schokkenbroek | 75/53 |
| 3,716,352 | 2/1973 | Ooi | 75/58 |
| 3,809,547 | 5/1974 | Lewis | 75/58 |
| 3,827,880 | 8/1974 | Greeson | 75/53 |
| 3,884,679 | 5/1975 | Mitteldorf | 75/53 |
| 4,049,442 | 9/1977 | Freissmuth | 75/53 |

*Primary Examiner*—P. D. Rosenberg

*Attorney, Agent, or Firm*—Sprung, Felfe, Horn, Lynch & Kramer

[57] ABSTRACT

Molten metals, especially molten pig iron, are desulfurized by contacting them with a composition comprising calcium carbide or calcium cyanamide and an additive agent yielding water or hydrogen at the temperature of the molten metal; preferred as the additive agents are the alkali metal hydrides, polyethylene or polyamide for yielding hydrogen and hydrate of lime and alkaline earth borates for yielding water.

39 Claims, No Drawings

METHOD AND COMPOSITION FOR THE DESULFURIZATION OF MOLTEN METALS

This is a division of application Ser. No. 408,954, filed Oct. 23, 1973, now U.S. Pat. No. 4,078,915.

The present invention relates to compositions for the desulfurization of molten metals, especially of molten pig iron. The compositions contain calcium carbide and/or calcium cyanamide with an additive increasing the desulfurization effect.

Sulfur contained in pig iron impairs especially the mechanical properties of ferrous materials and therefore appreciable amounts of it in such materials are undesirable. Since the selection and procurement of starting materials for the manufacture of low-sulfur ferrous products is becoming increasingly difficult, the molten irons in general must be subjected to a desulfurizing treatment. However, in the production of steel from pig iron the removal of the sulfur from the molten iron is difficult and uneconomical; it is more advantageous to initially reduce the sulfur in the pig iron to sufficiently low levels.

Known methods of desulfurizing molten iron outside of the melting unit make use of desulfurizing agents consisting of two or more solids in fine powdered form. These are fluidized by means of a carrier current of gas--air, nitrogen, argon, natural gas and other neutral gases or gases having a reducing action may be used--and blown into the molten iron. The reaction between the solid desulfurizing agent and the sulfur bound to the iron takes place on the surface of the desulfurizing agent.

Also known are desulfurization processes in which calcium cyanamide or calcium carbide are blown into the molten iron together with fine powdered carbon materials such as soft coal, anthracite, brown coal, coke, petroleum coke and other products containing carbon, which provide a reducing atmosphere conducive to desulfurization.

A definite advance has been achieved by desulfurization with combinations of calcium cyanamide or calcium carbide and diamide lime (W. German Pat. Nos. 1,583,268 and 1,758,250). Such agents not only create within the molten metal the desired reducing atmosphere in which the desulfurizing agent produces its effect without delay, but also, by the simultaneous yielding of gas from the diamide lime, they promote the uniform distribution of the desulfurizing agent into all parts of the melt and accelerate the precipitation of the desulfurization products.

In spite of these good results, there has been a need in metallurgical plant practice to improve desulfurizing agents based on calcium cyanamide and/or calcium carbide with regard to the degree of desulfurization which they achieve and with regard to their accuracy and reliability in achieving low sulfur content levels.

The present invention provides a desulfurization composition capable of achieving these objectives.

Essentially, the invention comprises a desulfurizing composition based on calcium carbide and/or calcium cyanamide and containing an agent which yields hydrogen and/or water at the temperature of the molten metal being treated with the solid desulfurizing compositions.

Suitable agents are, for example:

(a) For yielding $H_2$: calcium hydride and the hydrides of other alkaline earth and alkali metals, organic polymers containing hydrogen, e.g., polyolefins such as polyethylene and polypropylene, polyamides, polystyrene, and polyacrylonitrile, either individually or in mixtures, as well as urea, guanidines, biguanidines, dicyandiamide, dicyandiamidine and melamine.

(b) For yielding $H_2O$: calcium hydroxide (hydrate of lime, $Ca(OH)_2$), alkaline earth borates containing water of crystallization, such as colemanite and pandermite, aluminum hydroxides, perlite, kaolin, clays and other such minerals, carbohydrates such as sugar and starch, solid organic oxygen compounds such as phthalic acid and glycolic acid, organic polymers containing hydrogen and oxygen such as polyvinyl alcohol and polyvinyl acetate, and polyalcohols such as sorbitol.

The organic polymers may be prepared by many different polymerization processes and in many different degrees of polymerization. The nitrogen simultaneously yielded by nitrogen-containing additives during the treatment does not impair the desulfurization effect.

Hydrate of lime is preferred as the $H_2O$ yielding agent, since it is available at low cost virtually anywhere in the world without high transportation cost.

The decomposition of the powdered agent of the invention forms a desirable reducing atmosphere even before the actual desulfurizing agent begins its action. The agents decompose spontaneously at the temperatures of the molten metal (from about 1200° to 1450° C. in the case of iron) with the formation of water or hydrogen, nitrogen in some cases, and in some cases very finely divided carbon. The carbon, in the active form in which is it thus produced, exercises an advantageous action partially by binding the small amounts of oxygen dissolved in the iron, but mainly by forming carbon monoxide with the oxygen content of the desulfurizing agent or reacting with the oxygen in the carrier gas, or by forming carbon dioxide from carbonate components. The gases that are produced intensify the turbulence in the melt, increase the movement of the bath and assure the reducing status.

It has been found desirable for the amount of the agents to range from 0.3 to 60% by weight, the amount of hydrogen gas yielding substances being best between 0.3 and 20%, the amount of water yielding substances between 1 and 60%, preferably 5 and 40%; in the case of carbohydrates 1 to 30% will suffice.

According to a special embodiment of the invention, the desulfurizing composition of the invention will additionally contain deoxidizers such as aluminum or calcium silicon in amounts of up to about 10% by weight or carbon in amounts of up to about 20% by weight. In this manner, the desired reducing atmosphere is favored. The basic desulfurizing agent, calcium crbide or calcium cyanamide, is present in an amount of at least 30%, preferably at least 45%, by weight.

Especially advantageous mixtures have the following composition as shown in the indicated tables below showing performance data.

| | | |
|---|---|---|
| 1) Calcium carbide | 60 – 90% | (cf. Table HT 10, 11) |
| Diamide lime | 5 – 39.7% | |
| Polyethylene | 0.3 – 5% | |
| 2) Calcium carbide | 85 – 99% | (cf. Table HT 8) |
| Dicyandiamide | 1 – 15% | |
| 3) Calcium carbide | 60 – 80%, especially 72 – 78% | |

-continued

| | | |
|---|---|---|
| Carbon | 5 – 20%, especially 5 – 7% | |
| $Ca(OH)_2$ | 5 – 35%, especially 15 – 23% | |

• (cf. Table HT 17, 18)

| | | |
|---|---|---|
| 4) Calcium cyanamide | 60 – 85% | (cf. Table HT 19) |
| Carbon | 1 – 10% | |
| $Ca(OH)_2$ | 5 – 30% | |
| 5) Calcium cyanamide | 60 – 80% | (cf. Table HT 12) |
| Diamide lime | 18 – 39.7% | |
| Polyethylene | 0.3 – 2% | |
| 6) Calcium carbide | 65 – 95% | (cf. Table B 14) |
| $Ca(OH)_2$ | 5 – 35% | |
| 7) Calcium carbide | 90 – 99.5% | (cf. Table HT 7) |
| Polyethylene | 0.5 – 10% | |
| 8) Calcium carbide | 60 – 98% | (cf. Table B 15) |
| Alkaline earth borate | 2 – 40% | |
| 9) Calcium cyanamide | 85 – 99% | (cf. Table HT 9) |
| Dicyandiamide | 1 – 15% | |
| 10) Calcium hydroxide | 40 – 95% | (cf. Table HT 27) |
| Diamide lime | 0 – 49.7% | |
| Polyethylene | 0.3 – 20% | |
| 11) Calcium carbide | 30 – 99.7% | (cf. Table B 29) |
| Calcium hydroxide | 0 – 50% | |
| Dicyandiamide | 0.3 – 20% | |
| 12) Calcium carbide | 30 – 95% | (cf. Table B 26) |
| Diamide lime | 0 – 49.7% | |
| Dicyandiamide | 0.3 – 20% | |
| 13) Calcium carbide | 30 – 95% | (cf. Table HT 28) |
| Calcium hydroxide | 1 – 60% | |
| Polyethylene | 0.3 – 10% | |
| 14) Calcium carbide | 30 – 95% | (cf. Table B 30) |
| Carbon | 0 – 20% | |
| Calcium hydroxide | 5 – 60% | |
| 15) Calcium carbide | 30 – 95% | (cf. Table HT 31) |
| Carbon | 0 – 20% | |
| Colemanite | 5 – 50% | |
| 16) Calcium carbide | 50 – 80% | (cf. Table B 32) |
| Diamide lime | 10 – 20% | |
| Coke dust | 1 – 15% | |
| Colemanite | 5 – 15% | |
| 17) Calcium carbide | 50 – 80% | (cf. Table B 33) |
| Coke dust | 5 – 20% | |

-continued

| | | |
|---|---|---|
| Colemanite | 10 – 30% | |
| 18) Calcium cyanamide | 75 – 95% | (cf. Table HT 16) |
| Alkaline earth borate | 5 – 25% | |
| 19) Calcium carbide | 30 – 90% | (cf. Table B 22) |
| Diamide lime | 0 – 49% | |
| Alkaline earth borate | 1 – 40% | |
| 20) Calcium carbide | 60 – 80% | (cf. Table HT 20) |
| Petroleum coke | 15 – 30% | |
| Polyvinyl alcohol | 5 – 10% | |

All percentages given refer to the weight, unless otherwise specified.

The desulfurizing agents of the invention are prepared by mixing the components, whereupon moisture adhering to the agent reacts with the basic desulfurizing agent with the formation of acetylene (in the case of $CaC_2$) or $Ca(OH)_2$, so as to assure that the agent can contain only bound $H_2O$.

The desulfurizing agents of the invention provide additional effects when they are used, so that the amount of desulfurizing agent used is less than it has been in the case of the agents known hitherto, or the degree of desulfurization is greater for the same amount. Final sulfur contents are attained of 0.02% $S_E$ to 0.01% $S_E$ for a starting sulfur content of 0.04 to 0.15% $S_A$, with the accuracy desired in modern-day practice.

With the mixtures of the invention equally good results are achieved in the desulfurization of molten pig iron and ferrous alloys such as ferrochromium and ferronickel, and also in nonferrous molten metals such as nickel, copper and the like.

The invention will be explained with the aid of the following examples. Examples 1–6 contain comparisons with desulfurizing agents of the prior art, and Examples 7–24 show the effect of desulfurizing agent of the invention.

| Examples for Purposes of Comparison: | | | |
|---|---|---|---|
| No. | Base Composition | Agent | Identical to equivalent amounts |
| B 1 | Calcium carbide | — | — |
| B 2 | Calcium cyanamide | — | — |
| B 3 | Calcium carbide + carbon | — | — |
| B 4 | Calcium cyanamide + carbon | — | — |
| B 5 | Calcium carbide + diamide lime | — | — |
| B 6 | Calcium cyanamide + diamide lime | — | — |
| Agents which evolve $H_2$: | | | |
| HT 7 | Calcium carbide | Polyethylene | Polypropylene instead of polyethylene |
| HT 8 | Calcium carbide | Dicyandiamide | Dicyandiamidine, melamine, urea, polyacrylonitrile, instead of dicyandiamide |
| HT 10, 11 | Calcium carbide + diamide lime | Polyethylene | |
| HT 13 | Calcium carbide | | |

-continued

| No. | Base Composition | Agent | Identical to equivalent amounts |
|---|---|---|---|
| | + diamide lime | Polyamide | Calcium cyanamide instead of calcium carbide + diamide lime |
| HT 9 | Calcium cyanamide | Dicyandiamide | Identical to polyethylene or polyamide instead of dicyandiamide |
| HT 12 | Calcium cyanamide + diamide lime | Polyethylene | Calcium cyanamide without diamide lime |
| HT 26 | Calcium carbide + diamide lime | Dicyandiamide | |
| HT 27 | Calcium carbide + diamide lime | Polyethylene | |
| Agents which evolve $H_2O$: | | | |
| B 14 | Calcium carbide | Calcium hydroxide | |
| B 15 | Calcium carbide | Alkaline earth borate | |
| HT 17 & 18 | Calcium carbide + carbon | Calcium hydroxide | Aluminum hydroxide instead of calcium hydroxide |
| HT 20 | Calcium carbide + carbon | Polyvinyl alcohol | Starch, sorbitol, polyvinyl acetate and other organic oxygen compounds instead of polyvinyl alcohol. |
| HT 21 | Calcium carbide + diamide lime | Perlite | Kaolin, clay |
| B 22 | Calcium carbide + diamide lime | Alkaline earth borate | |
| HT 24 | Calcium carbide + diamide lime | Alkaline earth borate aluminum | |
| HT 16 | Calcium cyanamide | Alkaline earth borate | |
| HT 19 | Calcium cyanamide + carbon | Calcium hydroxide | Cane sugar instead of calcium hydroxide |
| HT 23 | Calcium cyanamide + diamide lime | Alkaline earth borate | |
| B 25 | Calcium carbide | Calcium hydroxide | |
| B 30 | Calcium carbide + carbon | Calcium hydroxide | |
| HT 31 | Calcium carbide + carbon | Colemanite | |
| B 32 | Calcium carbide + diamide lime + carbon | Colemanite | |
| B 33 | Calcium carbide + carbon | Colemanite | |
| Agents which evolve $H_2$ and $H_2O$: | | | |
| HT 28 | Calcium carbide | Calcium hydroxide Polyethylene | |
| B 29 | Calcium carbide | Calcium hydroxide Dicyandiamide | |

The rest of the agents named are also usable in the same manner. Which agent is actually used will vary locally according to economic criteria.

EXAMPLES 1 to 24

The results given in the following table are averages obtained from up to 6 desulfurization tests where experiments on a pilot plant scale (HT) are involved. Where the results are based on factory tests (B) the desulfurization was performed in torpedo ladles containing approximately 200 metric tons of pig iron, based on an average of more than 20 treatments.

In all experiments, the powdered desulfurization agents were blown into a pig iron melt through refractory-jacketed blowing lances using air as the carrier-gas.

The $\alpha$-value given in the table is a characteristic which expresses the consumption of desulfurization agent in kilograms per metric ton of pig iron and a decrease of 0.01% in the sulfur content of the pig iron.

| | |
|---|---|
| Initial sulfur content | $= S_A$ |
| Final sulfur content | $= S_E$ |
| Degree of desulfurization+ | $= \frac{S_A - S_E}{S_A} \times 100$ |
| Difference between $S_A$ and $S_E$ | $= \Delta S$ |

+"E"-Rating

| Experiment No. | Base Composition | % | Type of Agent | kg/t | "E" Rating | $\alpha$ | $S_A$ | $S_E$ | $\Delta S$ |
|---|---|---|---|---|---|---|---|---|---|
| B 1 | Calcium carbide | 100 | — | 5.2 | 60 | 1.80 | 0.048 | 0.019 | 29 |
| B 2 | Calcium cyanamide | 100 | — | 14.2 | 65 | 2.80 | 0.085 | 0.035 | 50 |
| B 3 | Calcium carbide<br>Petroleum coke | 70<br>30 | — | 3.75 | 66 | 1.50 | 0.038 | 0.013 | 25 |
| B 4 | Calcium cyanamide<br>Coke dust | 95<br>5 | — | 8.0 | 69 | 1.95 | 0.060 | 0.019 | 41 |
| B 5 | Calcium carbide<br>diamide lime | 75<br>25 | — | 4.2 | 55 | 1.31 | 0.058 | 0.026 | 32 |
| B 6 | Calcium cyanamide<br>diamide lime | 70<br>30 | — | 8.5 | 60 | 2.18 | 0.065 | 0.026 | 39 |
| HT 7 | Calcium carbide | 94 | + 6% Polyethylene | 5.2 | 75 | 1.45 | 0.048 | 0.012 | 36 |
| HT 8 | Calcium carbide | 93 | + 7% Dicyandiamide | 4.4 | 69 | 1.42 | 0.045 | 0.014 | 31 |
| HT 9 | Calcium cyanamide | 92.5 | + 7,5% Dicyandiamide | 7.2 | 64 | 1.84 | 0.061 | 0.022 | 39 |
| HT 10 | Calcium carbide<br>diamide lime | 82.5<br>15 | + 2,5% Polyethylene | 6.0 | 83 | 1.25 | 0.058 | 0.010 | 48 |
| HT 11 | Calcium carbide<br>diamide lime | 74.7<br>25 | +0.3% Polyethylene | 5.5 | 80 | 1.41 | 0.049 | 0.010 | 39 |

-continued

| Experiment No. | Base Composition | % | Type of Agent | kg/t | "E" Rating | α | $S_A$ | $S_E$ | ΔS |
|---|---|---|---|---|---|---|---|---|---|
| HT 12 | Calcium cyanamide<br>diamide lime | 69.7<br>30 | +0.3% Poly-ethylene | 10.5 | 69 | 1.95 | 0.078 | 0.024 | 54 |
| HT 13 | Calcium carbide<br>diamide lime | 70<br>27.5 | +2.5% Poly-amide | 5.5 | 70 | 1.37 | 0.057 | 0.017 | 40 |
| B 14 | Calcium carbide | 80 | +20% $Ca(OH)_2$ | 5.4 | 76 | 1.45 | 0.049 | 0.012 | 37 |
| B 15 | Calcium carbide | 85 | +15% Colemanite | 5.8 | 70 | 1.41 | 0.059 | 0.018 | 41 |
| HT 16 | Calcium cyanamide | 80 | +20% Colemanite | 6.5 | 67 | 1.55 | 0.063 | 0.021 | 42 |
| HT 17 | Calcium carbide<br>Coke dust | 70<br>10 | +20% $Ca(OH)_2$ | 5.5 | 72 | 1.37 | 0.056 | 0.016 | 40 |
| HT 18 | Calcium carbide<br>Coke dust | 60<br>10 | +30% $Ca(OH)_2$ | 5.2 | 67 | 1.40 | 0.055 | 0.018 | 37 |
| HT 19 | Calcium cyanamide<br>Coke dust | 75<br>5 | +20% $Ca(OH)_2$ | 7.5 | 68 | 1.78 | 0.062 | 0.020 | 42 |
| HT 20 | Calcium carbide<br>Petroleum coke | 70<br>20 | + 10% Poly-vinyl alcohol | 5.8 | 80 | 1.42 | 0.051 | 0.010 | 41 |
| HT 21 | Calcium carbide<br>diamide lime | 60<br>10 | + 30% Perlite | 5.3 | 89 | 1.29 | 0.051 | 0.010 | 41 |
| B 22 | Calcium carbide<br>diamide lime | 65<br>25 | + 10% Cole-manite | 5.0 | 80 | 1.19 | 0.053 | 0.011 | 42 |
| HT 23 | Calcium cyanamide<br>diamide lime | 63<br>20 | + 17% Pander-mite | 6.5 | 72 | 1.38 | 0.065 | 0.018 | 47 |
| HT 24 | Calcium carbide<br>diamide lime<br>Aluminum | 60<br>20<br>5 | + 15% Cole-manite | 4.8 | 82 | 1.14 | 0.051 | 0.009 | 42 |
| B 25 | Calcium carbide | 65 | + 35% Calcium hydroxide | 5.8 | 76 | 1.42 | 0.061 | 0.020 | 41 |
| B 26 | Calcium carbide<br>diamide lime | 65<br>30 | + 5% Dicyan-diamide | 5.4 | 73 | 1.26 | 0.059 | 0.016 | 43 |
| HT 27 | Calcium carbide<br>diamide lime | 60<br>34 | + 6% Poly-ethylene | 3.9 | 68 | 1.30 | 0.044 | 0.014 | 30 |
| HT 28 | Calcium carbide | 60 | 35% $Ca(OH)_2$<br>5% Polyethylene | 4.6 | 62 | 1.39 | 0.053 | 0.020 | 33 |
| B 29 | Calcium carbide | 60 | 34% $Ca(OH)_2$<br>6 % Dicyandiamide | 5.4 | 70 | 1.28 | 0.060 | 0.018 | 42 |
| B 30 | Calcium carbide<br>Carbon | 45<br>15 | + 40% Calcium hydroxide | 4.6 | 63 | 1.44 | 0.051 | 0.019 | 32 |
| HT 31 | Calcium carbide<br>Carbon | 50<br>15 | + 35% Cole-manite | 6.3 | 73 | 1.40 | 0.062 | 0.017 | 45 |
| B 32 | Calcium carbide<br>diamide lime<br>Coke dust | 75<br>12.5<br>3.5 | + 9 % Cole-manite | 7.0 | 77 | 1.37 | 0.066 | 0.015 | 51 |
| B 33 | Calcium carbide<br>Coke dust | 75<br>7 | + 18% Cole-manite | 7.0 | 80 | 1.32 | 0.066 | 0.013 | 53 |

It will be understood that the foregoing specification and examples are illustrative but not limitative of the present invention inasmuch as other embodiments within the spirit and scope of the invention will suggest themselves to those skilled in the art.

What is claimed is:

1. Composition for the desulfurization of molten metals comprising at least one member selected from the group consisting of calcium carbide and calcium cyanamide as the desulfurizing agent present in an amount of at least 30 percent by weight and, in addition, a solid substance yielding water at desulfurization temperatures selected from the group consisting of calcium hydroxide, aluminum hydroxide, clay, perlite, kaolin, a carbohydrate, phthalic acid, glucolic acid, an organic polymer containing hydrogen and oxygen, and a polyalcohol.

2. Composition as claimed in claim 1, wherein said additive agent is a water-yielding solid substance present in an amount of from 1 to 60% by weight of the total composition.

3. Composition as claimed in claim 2, wherein said water-yielding solid substance is present in an amount of from 5 to 40% by weight of the total composition.

4. Composition as claimed in claim 1, wherein said hydrogen-yielding solid substance is a polyolefin.

5. Composition as claimed in claim 1, wherein said hydrogen-yielding solid substance is a polyamide.

6. Composition as claimed in claim 1, wherein said hydrogen-yielding solid substance is a polystyrene.

7. Composition as claimed in claim 1, wherein said hydrogen-yielding solid substance is a polyacrylonitrile.

8. Composition as claimed in claim 1, wherein said hydrogen-yielding solid substance is at least one of urea, guanidine and biguanidine.

9. Composition as claimed in claim 1, wherein said hydrogen-yielding solid substance is at least one of dicyandiamide and dicyandiamidine.

10. Composition as claimed in claim 1, wherein said hydrogen-yielding solid substance is melamine.

11. Composition as claimed in claim 2, wherein said water-yielding solid substance is an alkaline earth borate containing water of crystallization.

12. Composition as claimed in claim 2, wherein said water-yielding solid substance is aluminum hydroxide.

13. Composition as claimed in claim 2, wherein said water-yielding solid substance is at least one of clay, perlite and kaolin.

14. Composition as claimed in claim 2, wherein said water-yielding solid substance is a carbohydrate.

15. Composition as claimed in claim 2, wherein said water-yielding solid substance is at least one of phthalic acid and glycolic acid.

16. Composition as claimed in claim 2, wherein said water-yielding solid substance is an organic polymer containing hydrogen and oxygen.

17. Composition as claimed in claim 16, wherein said organic polymer is polyvinyl alcohol or polyvinyl acetate.

18. Composition as claimed in claim 5, wherein said water-yielding solid substance is a polyalcohol.

19. Composition as claimed in claim 1 wherein said water yielding solid substance is sorbitol.

20. Composition as claimed in claim 1, wherein said additive agent is calcium hydroxide contained in an amount of from 1 to 60% by weight of the total composition.

21. Composition as claimed in claim 20, wherein said amount is from 5 to 40% by weight.

22. Composition as claimed in claim 1, wherein said additive agent is a carbohydrate contained in an amount of from 1 to 30% by weight of the total composition.

23. Composition as claimed in claim 1 wherein said additive agent is an alkaline earth borate containing water of crystallization contained in an amount of from 1 to 50% by weight of the total composition.

24. Composition as claimed in claim 1 wherein said water yielding solid substance contains carbon-containing substances in an amount up to about 20% by weight of the total composition with calcium hydroxide, wherein the molar ratio of calcium hydroxide to the carbon contained in said carbon-containing substance is from 10.0 to 0.1.

25. Composition as claimed in claim 1 consisting essentially of the following:
Calcium carbide: 30–95%
Diamide lime: 0–49.7%
Dicyandiamide: 0.3–20% by weight of total composition.

26. Composition as claimed in claim 1 consisting essentially of the following:
Calcium carbide: 30–99.7%
Calcium hydroxide: 0–50%
Dicyandiamide: 0.3–20% by weight of total composition.

27. Composition as claimed in claim 1 consisting essentially of the following:
Calcium carbide: 85–99%
Dicyandiamide: 1–5% by weight of total composition.

28. Composition as claimed in claim 1 consisting essentially of the following:
Calcium carbide: 65–95%
Calcium hydroxide: 5–35% by weight of total composition.

29. Composition as claimed in claim 1 consisting essentially of the following:
Calcium Carbide: 30–95%
Carbon: 0–20%
Calcium hydroxide: 5–60% by weight of total composition.

30. Composition as claimed in claim 1 consisting essentially of the following:
Calcium carbide: 60–80%
Carbon: 5–20%
Calcium hydroxide: 5–35% by weight of total composition.

31. Composition as claimed in claim 1 consisting essentially of the following:
Calcium carbide: 72–78%
Carbon: 5–7%
Calcium hydroxide: 15–23% by weight of total composition.

32. Composition as claimed in claim 1 consisting essentially of the following:
Calcium cyanamide: 60–85%
Carbon: 1–10%
Calcium hydroxide: 5–30% by weight of total composition.

33. Composition as claimed in claim 1 consisting essentially of the following:
Calcium carbide: 30–95%
Carbon: 0–20%
Colemanite: 5–50% by weight of total composition.

34. Composision as claimed in claim 1 consisting essentially of the following:
Calcium carbide: 30–90%
Diamide lime: 0–49%
Colemanite: 1–50% by weight of total composition.

35. Composition as claimed in claim 1 consisting essentially of the following:
Calcium carbide: 50–80%
Diamide lime: 10–20%
Colemanite: 5–15%
Coke dust: 1–15% by weight of total composition.

36. Composition as claimed in claim 1 consisting essentially of the following:
Calcium carbide: 50–80%
Coke dust: 5–20% sd
Colemanite: 10–30% by weight of total composition.

37. Composition as claimed in claim 1 consisting essentially of the following:
Calcium carbide: 50–70%
Diamide lime: 15–25%
Colemanite: 10–34%
Aluminum: 1–5% by weight of total composition.

38. Method of desulfurizing a molten metal, which method comprises contacting said metal at a temperature from about 1200° to 1450° C. with a composition as claimed in claim 1 wherein said composition comprises an additive agent selected from the hydrides of other alkaline earth and alkali metals; organic polymers containing hydrogen and osygen; urea, guanidines, biguanidines; dicyandiamide, dicyandiamidine; and melamine.

39. Method of desulfurizing a molten metal, which method comprises contacting said metal at a temperature from about 1200° to 1450° C. with a composition as claimed in claim 1 wherein said composition comprises an additive agent selected from calcium hydroxide, aluminum hydroxide, alkaline earth borates containing water of crystallization, perlite, kaolin, clay, carbohydrates, glycolic acid, solid organic oxygen compounds, polyvinyl alcohol, polyvinyl acetate and sorbitol.

* * * * *

UNITED STATES PATENT AND TRADEMARK OFFICE

CERTIFICATE OF CORRECTION

PATENT NO. : 4,159,906

DATED : July 3, 1979

INVENTOR(S) : Walter Meichsner et al

It is certified that error appears in the above-identified patent and that said Letters Patent are hereby corrected as shown below:

At page 1, insert
No. [30] "Foreign Application Priority Data"

| | |
|---|---|
| Germany P 22 52 795.3 | October 27, 1972 |
| Germany P 22 52 796.4 | October 27, 1972 |
| Germany P 23 42 405.7 | August 22, 1973 |

Column 5, at lines 7:

First four lines in box at column 5 relate to Example No. HT13 at column 4.

Column 10, line 24 "Composision" should read "Composition"

Signed and Sealed this

Seventh Day of July 1981

[SEAL]

Attest:

RENE D. TEGTMEYER

Attesting Officer

Acting Commissioner of Patents and Trademarks